United States Patent [19]

Wilson

[11] Patent Number: 4,993,236

[45] Date of Patent: Feb. 19, 1991

[54] SENSITIVE PRESSURE ACTUATED AUTOMATIC SELF-COOLING DEVICE FOR BEVERAGE CONTAINERS

[76] Inventor: John J. Wilson, 723 Camino, Ste. 181, San Bruno, Calif. 94066-4315

[21] Appl. No.: 506,445

[22] Filed: Apr. 6, 1990

Related U.S. Application Data

[60] Continuation-in-part of Ser. No. 286,525, Dec. 19, 1988, which is a division of Ser. No. 118,413, Oct. 6, 1987, Pat. No. 4,791,789.

[51] Int. Cl.[5] ..... F25D 3/08

[52] U.S. Cl. ..... 62/293; 62/371

[58] Field of Search ..... 62/293, 371, 294

[56] References Cited

U.S. PATENT DOCUMENTS

| | | | |
|---|---|---|---|
| 2,900,808 | 8/1959 | Wang | 62/293 X |
| 3,373,581 | 3/1968 | Strader | 62/371 X |
| 3,520,148 | 7/1970 | Fuerle | 62/371 X |
| 3,842,617 | 10/1974 | Chase et al. | 62/371 X |
| 3,987,643 | 10/1976 | Willis | 62/371 |
| 4,054,037 | 10/1977 | Yoder | 62/371 |
| 4,628,703 | 12/1986 | Kim | 62/371 |

*Primary Examiner*—William E. Tapolcai

[57] ABSTRACT

A discrete internal self-cooling device (106) installed in a standard beverage can (100) during assembly. An evaporative cryogenic refrigerant vessel (112) has a cylinder vent hole (118) formed through it near its upper rim (120) adjacent to cylinder (126). An upper plug (122) sealing (112) has off-set inner (123) and outer (125) metering orifice segments formed in it axially. Intersecting these segments, an automatic pressure actuated release means comprises a transverse plug cylinder (126) containing a pressure actuated piston (131) carrying two axially rotatable rings (133) which form a circular piston channel (135) that opens or closes orifice segments (123) and (125) depending on its alignment with them. Alternative piston and rings configurations are provided. A means for thermally insulating vessel (112) from can (110) is provided by thermal transfer fin-spacers (110).

11 Claims, 15 Drawing Sheets

SENSITIVE PRESSURE ACTUATED AUTOMATIC SELF-COOLING DEVICE FOR BEVERAGE CONTAINERS

CROSS-REFERENCE TO RELATED APPLICATIONS

This is a continuation-in-part of U.S. patent application Ser. No. 07/286,525, filed Dec. 19, 1988; which in turn is a division of U.S. patent application Ser. No. 07/118/413, filed Oct. 6, 1987, now U.S. Pat. No. 4,791,789, issued Dec. 20, 1988.

A document evidencing conception of this invention was filed Sept. 5, 1988 in the U.S. Patent Office Disclosure Program, No. 210134.

FIELD OF THE INVENTION

This invention relates generally to self-cooling or self-heating comestible containers, and more specifically to automatic internal self-cooling devices for beverage containers.

BACKGROUND OF THE INVENTION

To this time, self-cooling beverage containers have not met with widespread commercial success due to design deficiencies of economy, operability, manufacture, process, health and safety, or convenience. In most cases, manufacture has been impractical due to complexities arising from the integral construction of the beverage container, and the self-cooling apparatus that resulted in expensive tooling or expensive and extensive modification of the beverage container assembly and fill process. An example is the self-cooling can disclosed in the April, 1987 issue of *Popular Science*. page 53, showing a self-cooling can which includes a scored capillary tube that is lead into a $CO_2$ container, integral to the can. When the scored tube is broken, the $CO_2$ is released and cools the beverage. However, integration of the construction of the integrated container into beverage can in the manner disclosed in this article would be so expensive as to render this system unmarketable. Similarly, recent examples appear in the September, 1988 issue of *Prepared Foods*. pages 98 and 101, revealing self-cooling and -heating containers, but being integrally constructed, they are complex and therefore expensive. Furthermore, efficient cryogenic refrigerants were seldom considered so that refrigerant volumes were too large displacing too much beverage. The device of Weiss, U.S. Pat. No. 3,269,141 suggests the possibility of frostbite from touching the over-cooled refrigerant cartridge. Industrial refrigerants were used in some prior devices, but they are malodorous and possibly poisonous.

SUMMARY OF THE INVENTION

Therefore, it is the objective of this invention to provide an economical, discrete, internal self-cooling device to be used inside standard beverage containers.

A further objective of this invention is to provide an efficient self-cooling device using cryogenic refrigerants such as produced from inert atmospheric gases. These minimize the refrigerant volume and maximize the beverage volume within the standard sized beverage containers.

Another objective herein is to provide healthful, self-cooling device whose atmospheric refrigerant is neither malodorous nor poisonous.

Another objective herein is to provide a convenient self-cooling device that operates automatically upon opening the beverage container.

Further, it is an objective herein to provide a self-cooling device composed of simple, easily-manufactured components.

Another objective is to provide a self-cooling device for use in a container which is adaptable to various standard beverage container shapes and sizes.

A related objective is to provide a self-cooling device compatible with various materials requirements for economy, material recycling, convenience, and the like.

Another further objective is to provide a very sensitive pressure actuated self-cooling device.

These and other objectives are realized in a discrete, internal self-cooling device installed in a standard beverage can during assembly that operates, preferably, on the principle of heat loss through vaporization. In the present invention, a refrigerant vessel is provided for holding a cryogenic refrigerant. The vessel includes a refrigerant vessel body made up of cylindrical side walls with a cylinder vent hole formed through it near the upper refrigerant vessel rim.

The vessel sidewalls terminate in upper and lower plugs which seal the vessel. The upper plug includes a regulated refrigerant escape rate means comprising an off-set metering orifice having an inner segment, and an outer segment that extend into the plug axially. Intersecting these off-set metering orifice segments is an automatic pressure actuated release means comprising a transverse plug cylinder containing a pressure actuated piston having a circular piston channel that opens or closes the outer orifice segment, depending on its alignment with the outer orifice segment. This channel is refined as a space within the cylinder, between the rings, and around the piston means are provided for thermally insulating the refrigerant vessel from the surfaces of the can comprising thermal transfer fin-spacers that have large areas contacting the beverage, but small areas contacting the can, and small areas contacting the refrigerant vessel.

Further objects and advantages of this invention will become apparent to a person of skill in the art who studies the ensuing drawings and description.

DETAILED DESCRIPTION OF A PREFERRED EMBODIMENT

Figure 1:
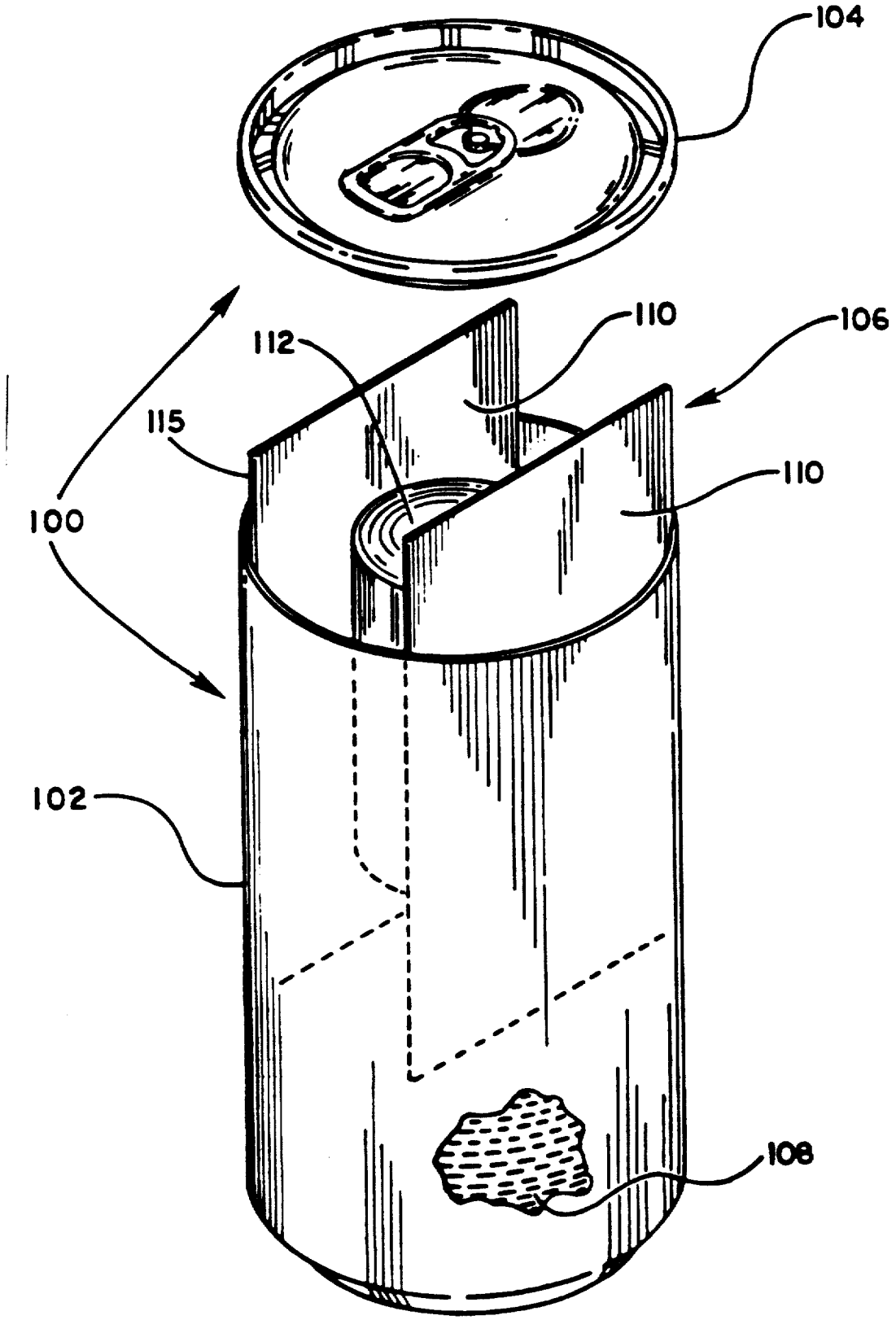
FIG. 1 shows exploded isometric view, partially in phantom, of a self-cooling device partially inserted into beverage can body.
Figure 2:
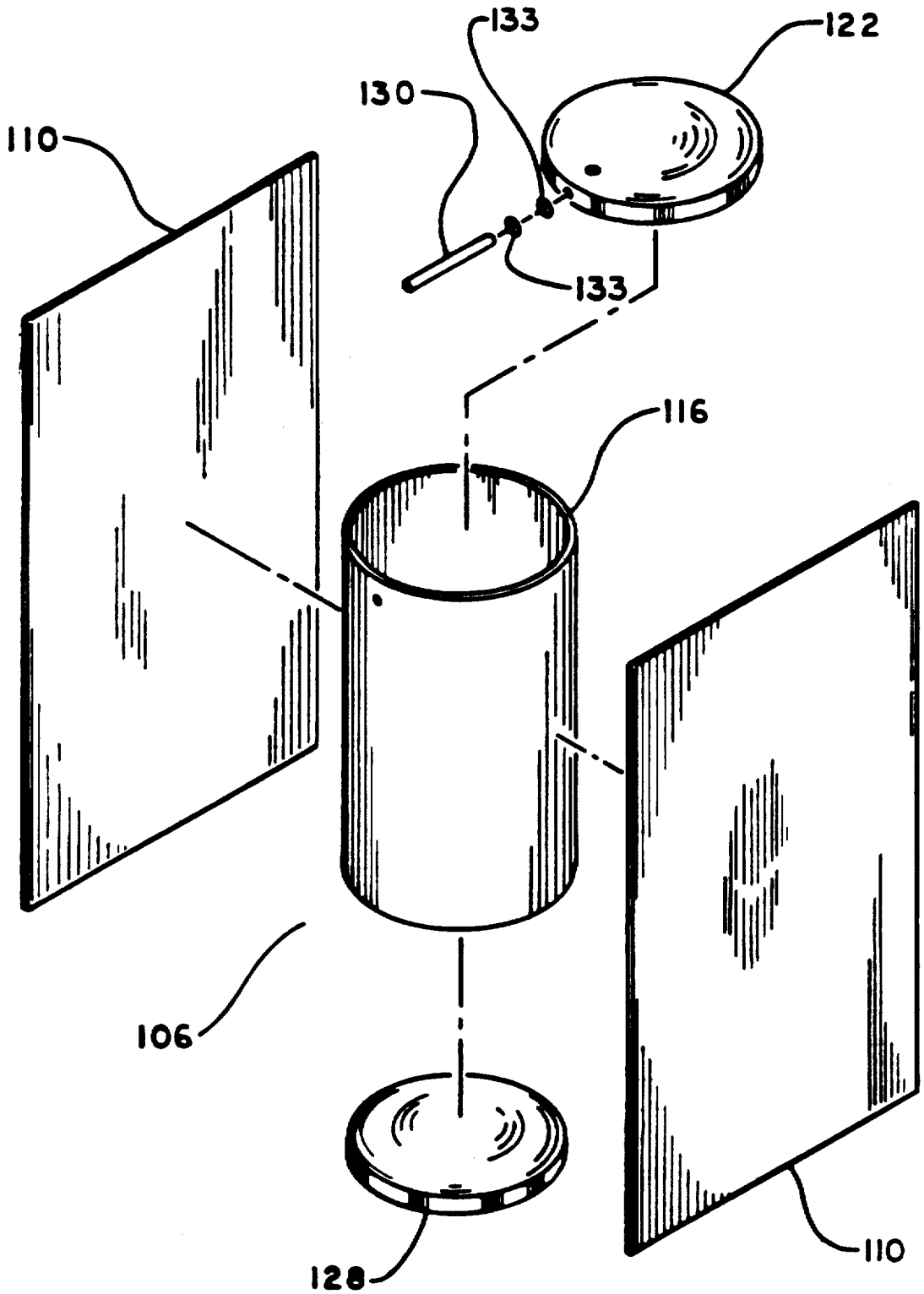
FIG. 2 shows exploded isometric view of self-cooling device.
Figure 3:
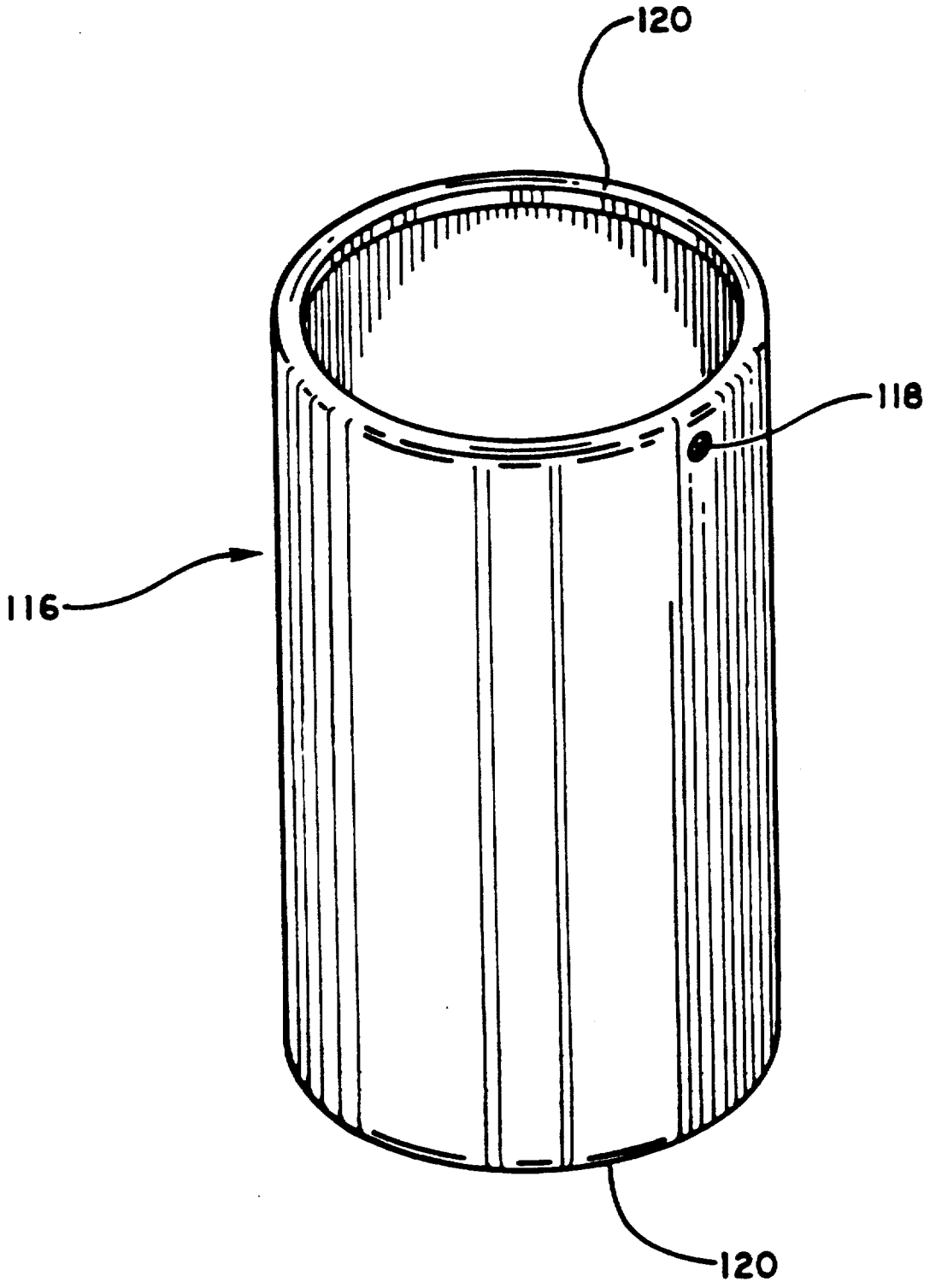
FIG. 3 shows isometric view of refrigerant vessel body.
Figure 5:
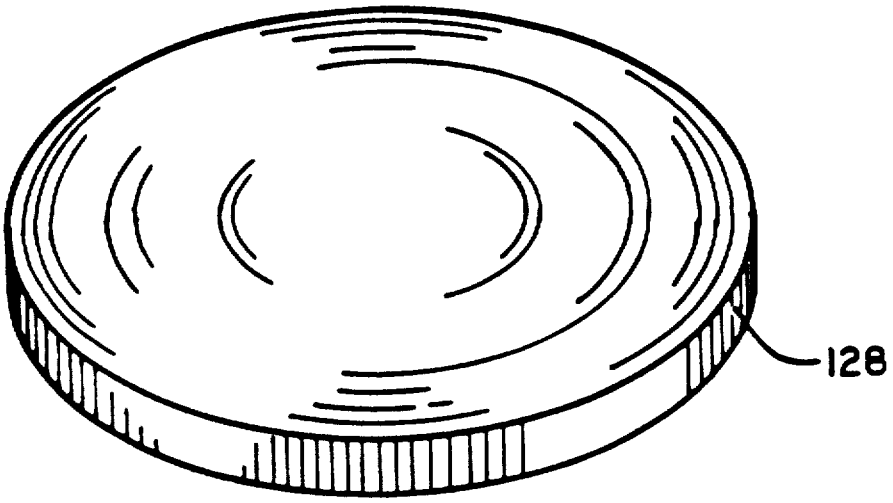
FIG. 5 shows isometric view of lower plug.
Figure 4:
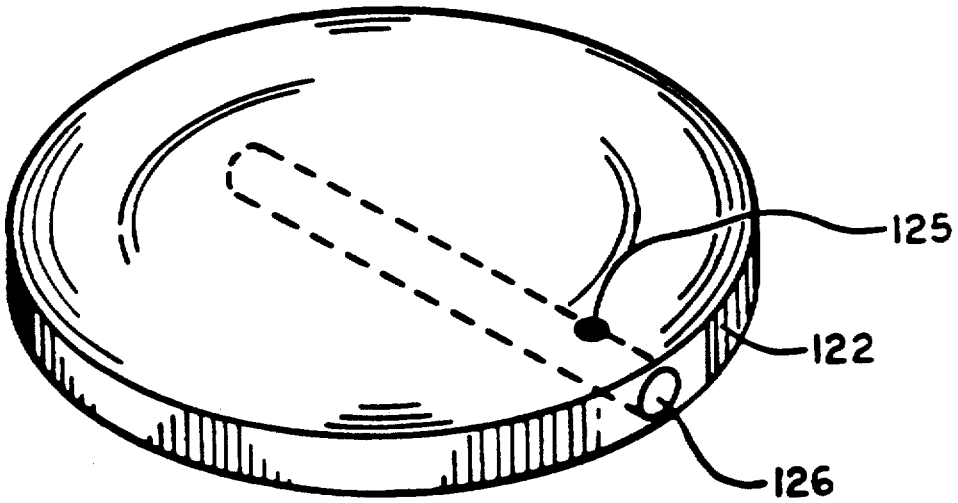
FIG. 4 shows isometric view of upper plug.

As noted above, FIG. 1 is an exploded isometric view of the self-cooling device 106 inserted in a beverage can 100 of known construction for cooling the contents of the can 100. It should be noted that throughout the several figures in these drawings, like elements will be denoted by like reference numerals.

The device 106 includes a cylindrical refrigerant vessel 112 associated with rectangular thermal transfer fin-spacers 110. The spacers 110 that have planar surfaces are attached to the sides of the refrigerant vessel 112 and space the vessel 112 from the surfaces of the can 100 that contains the beverage 108 which is to be cooled. They are preferably spot welded to opposite sides of the vessel 112 and are parallel to one another. Their edges 115 touch the interior of the can 100, centrally locating the refrigerant vessel 112 inside the can. The spacers 110 insulate the vessel 112 from the can 100. The vessel 112 tends to cool the spacers, but the beverage tends to heat them; so the can 100 is not overcooled.

Figure 6:
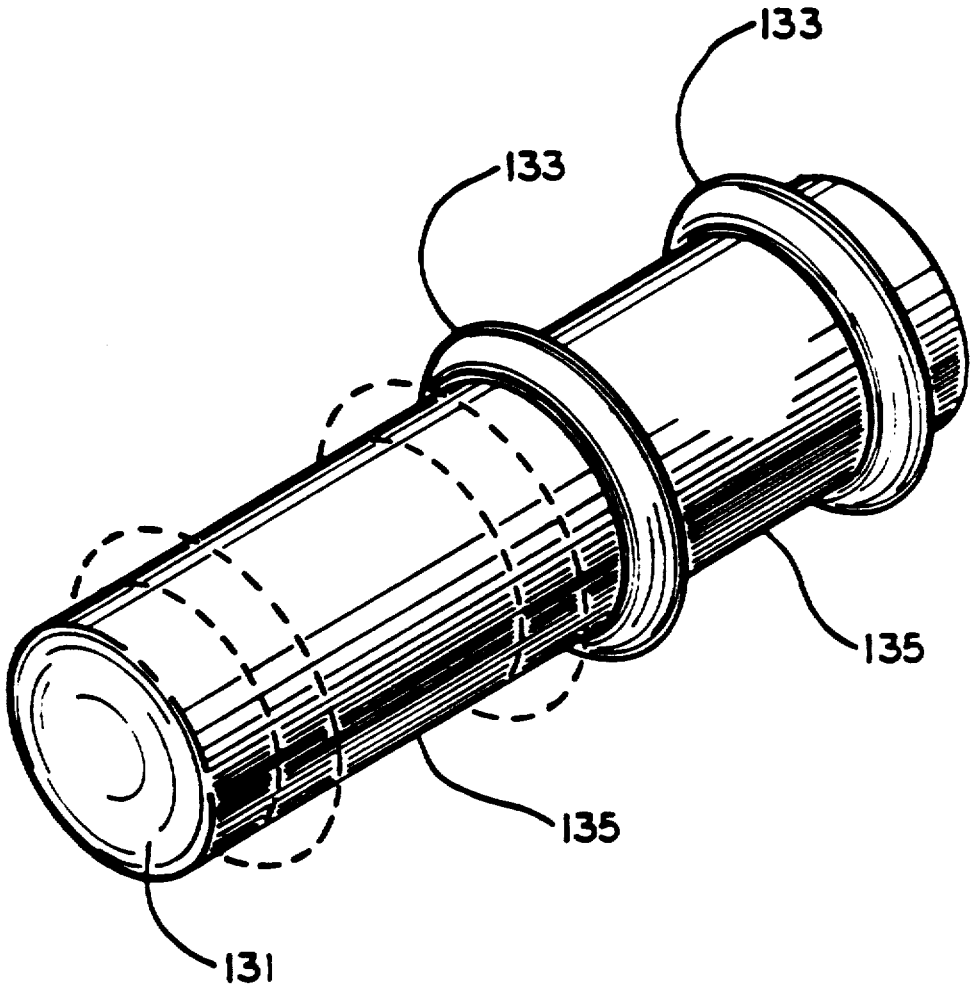
FIG. 6 shows isometric view of piston with axially rotatable rings at inserted location and phantom view of axially rotatable rings at uninserted location.
Figure 7:
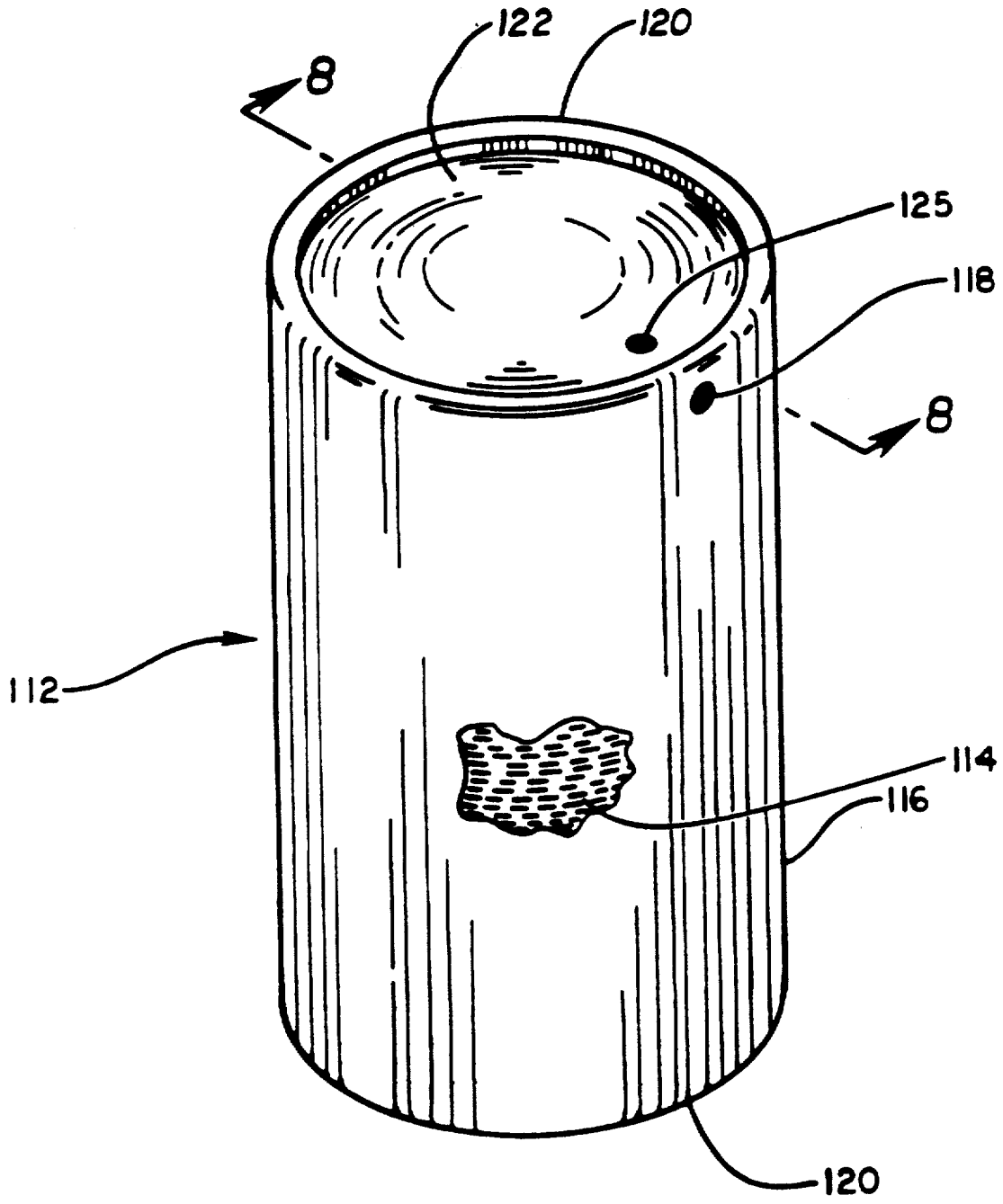
FIG. 7 shows isometric view of refrigerant vessel.

The refrigerant vessel 112 and its assembly and operation will be described with greater particularity with reference to FIGS. 3–8. The vessel 112 consists of six pieces: a refrigerant vessel body 116 (FIG. 3), an upper plug 122 (FIG. 4), a lower plug 128 (FIG. 5), a piston 131, and two axially rotatable piston rings 133 (FIG. 6). The refrigerant 114 which is to be contained within the vessel 112, is preferably a common, inert, tasteless, odorless, liquified, atmospheric gas, known examples of this gas are nitrogen or helium, or a mixture of them. The reason for providing these qualifications for the gas is to provide a refrigerant 114 which, when released into the beverage 108, changes the temperature of the beverage 108 without altering the flavor or odor thereof. However, while these gases are preferred, other gases ray be used based on their characteristic ability to provide the cooling effect without alteration of the beverage 108 taste or odor.

The refrigerant vessel body 116 is to be formed of a comparatively heavy gauge tube section having a circular vent hole 118 formed near one of the refrigerant vessel rims 120, the cylinder vent hole 118 being defined at the same end (typically the upper end) of the cylinder adjacent to the upper plug 122 and aligned with the cylinder 126 of the upper plug 122. The vent hole 118 is smaller than the piston 131 so that the piston cannot fall out of the cylinder 126 after plugging the body 116 with plug 122. The upper 122 and lower 128 plugs are butted against the rims 120 at the upper and lower ends of the refrigerant vessel body 116.

Figure 8:
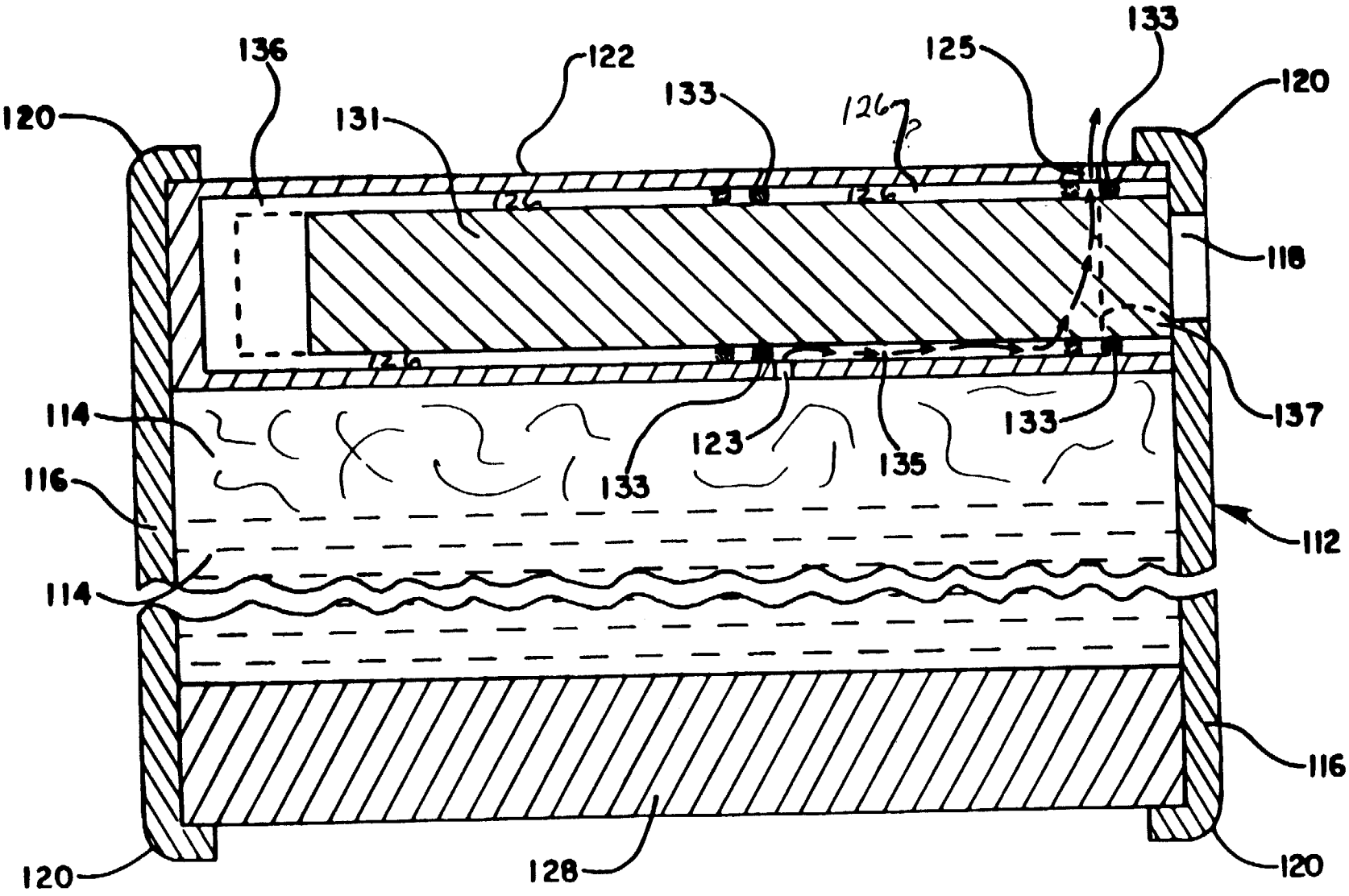
FIG. 8 shows enlarged sectional view, partially in phantom, of refrigerant vessel taken along line 8—8 of FIG. 7 and indicates edible beverage-soluble putty.
Figure 9:
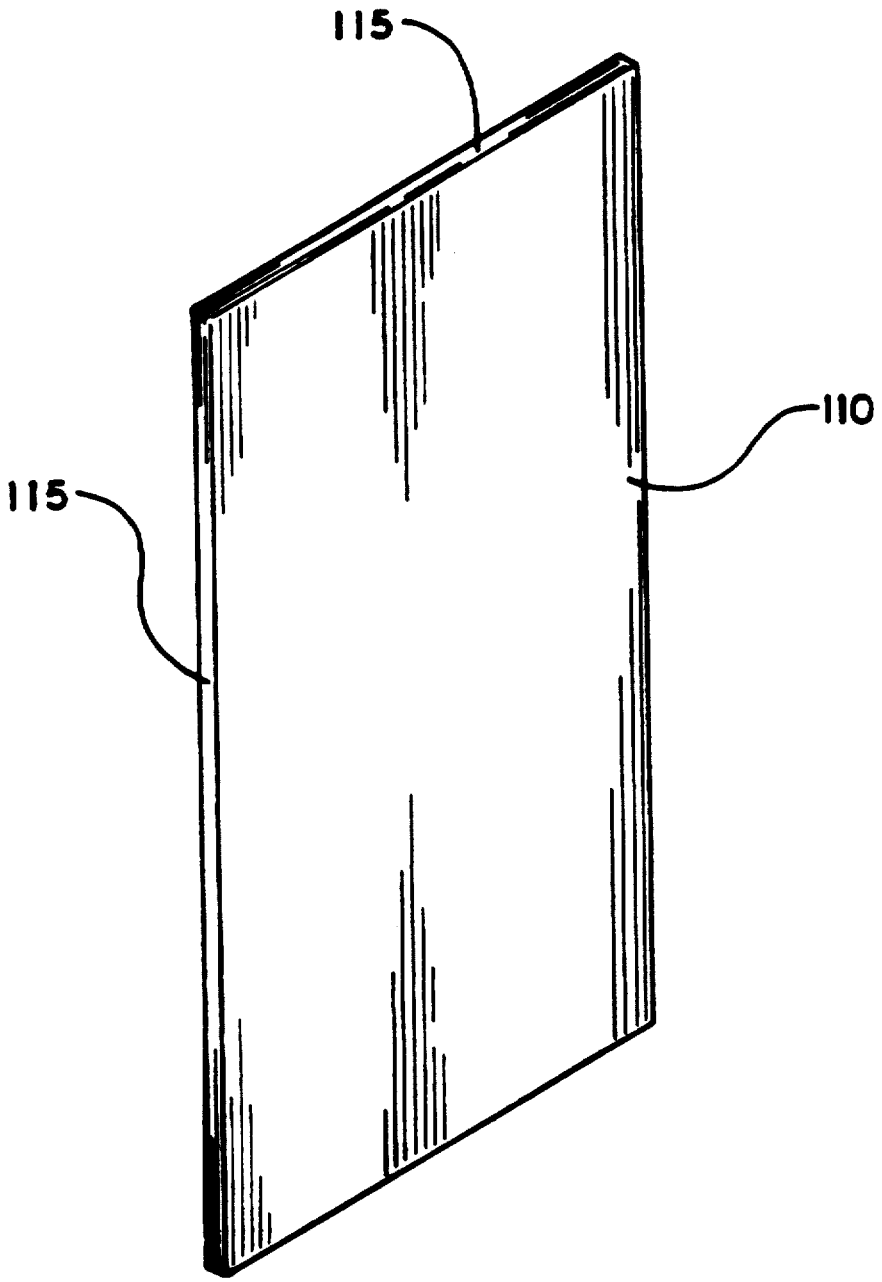
FIG. 9 shows isometric view of thermal transfer fin-spacer.

The lower plug 128 shown especially at FIG. 8, is simply used to seal the refrigerant 114 in the vessel 112. The upper plug 122, preferably a disc shaped member, has an off-set metering orifice with inner 123 and outer 125 segments extending into it axially. These offset segments 123 and 125, and the circular channel 135, will provide a communicating pathway for the refrigerant 114 stored in the interior of the vessel 112 to escape the vessel 112 reaching the interior of the can 100. By providing control means discussed below, the refrigerant 114 may be evacuated through off-set metering orifice segments 123 and 125 into the beverage 108 stored in the can 100 in order to cool the device 106 which in turn cools the beverage 108.

The metering orifice segments and 123 are controlled using a plug cylinder 126 that intersects them (see, e.g., FIG. 4) and a piston 131 with two axially rotatable rings 133 that are movable within the cylinder 126.

The piston 131 and the two axially rotatable rings 133 are shown in detail in FIG. 6, the rings being shown in solid lines at the inserted position and in phantom at the uninserted position.

Referring again to FIG. 8, the rod-shaped piston 131, the rotatable rings 133, and the cylinder 126 define a circular vapor channel 135 that will form a communicating pathway with the off-set metering orifice segments 123 and 125. Positioning of this channel 135 relative to the outer orifice segment 125, opens or closes the pathway from the inner segment 123 to pass the refrigerant 114 to the beverage 108 to be cooled. In its fully retracted position, the piston 131 defines a pressure chamber 136 in the inner portion of the cylinder. In this position, the piston 131 abuts the end wall 120 of body 116, but is too large to pass through vent hole 118.

In operation, a pressurized refrigerant 114 is provided in the vessel 112. When self-cooling action is desired, the refrigerant 114 is allowed to escape from the vessel 112 whereupon it expands and vaporizes. With vaporization, the refrigerant self cools to its vapor point, thereby absorbing much of the heat of the beverage 108. The cryogenic refrigerant 114 is recommended because of the small volume displacement results in limited reduction of the amount of beverage 108 stored. The extremely cold vessel 112 is itself insulated from the beverage can 100 by thermal transfer fin-spacers 110. Due to the respective contact area sizes, the fin-spacers 110 efficiently cool the beverage 108 but not the can 100. The fin-spacers 110 have large areas touching the beverage 108, but small areas touching the vessel 112 and the can 100; thus, little heat is absorbed directly from the can by the action of the refrigerant.

The automatic operation of the invention may be generally summarized as follows. When vessel 112 is assembled, axially rotatable rings 133 are installed on piston 131 at uninserted locations best seen in phantom in FIG. 6. It should be noted that axially rotatable rings 133, "roll", relative to cylinder 126; in this preferred embodiment, they each roll only one-half the relative distance piston 131 moves. Relative to piston 131, the rings 133 —roll" in the opposite direction one-half the distance piston 131 moves.

When piston 131 is inserted into cylinder 126, inner ring 133-I, which begins at the inner end of piston 131, moves to the middle of piston 131, and outer ring 133-O, that begins in the middle of piston 131 moves to the outer end (compare FIGS 6 and 8). When innermost ring 133 has been moved past inner metering orifice segment 123, air is pressurized in chamber 136 which tends to effect piston 131. Piston 131 must therefore be anchored in place at the closed position, seen in phantom in FIG. 8, so that it is not ejected before plug 122 seals body 116. This is accomplished as follows.

Piston 131 is held at the closed position and a drop of edible beverage soluble adhesive 137, such as melted sugar, is inserted into cylinder 126. Hot syrup 137 then cools and solidifies, as seen in phantom in FIG. 8, thereby anchoring piston 131 at the closed position. However, alternative modes may be provided that are not dependent upon this solidifying of melted sugar 137 effect. It will be seen that when piston 131 is anchored, plug 122 may be conveniently stored. Device 106 is thereafter plugged, inserted, and sealed inside beverage can 100.

Beverage 108 passes through vent hole 118, enters cylinder 126, and dissolves adhesive 137. Pressurized air in chamber 136 ejects piston 131 to the fully retracted position. In this position, circular channel 135 adjoins outer orifice segment 125. Escaping refrigerant 114 gradually flows through inner segment 123, channel 135, and outer segment 125, which slightly pressurizes can 100. This can pressure is transmitted via vent hole 118 to piston 131 pushing it back to the closed position. This closed position is maintained because of the pressurized state within the can until can 100 is opened, whereupon the can pressure falls. Then pressurized air in chamber 136 again ejects piston 131 to the open position. Escaping refrigerant 114 then expands, absorbing the heat of beverage 108.

Figure 19:
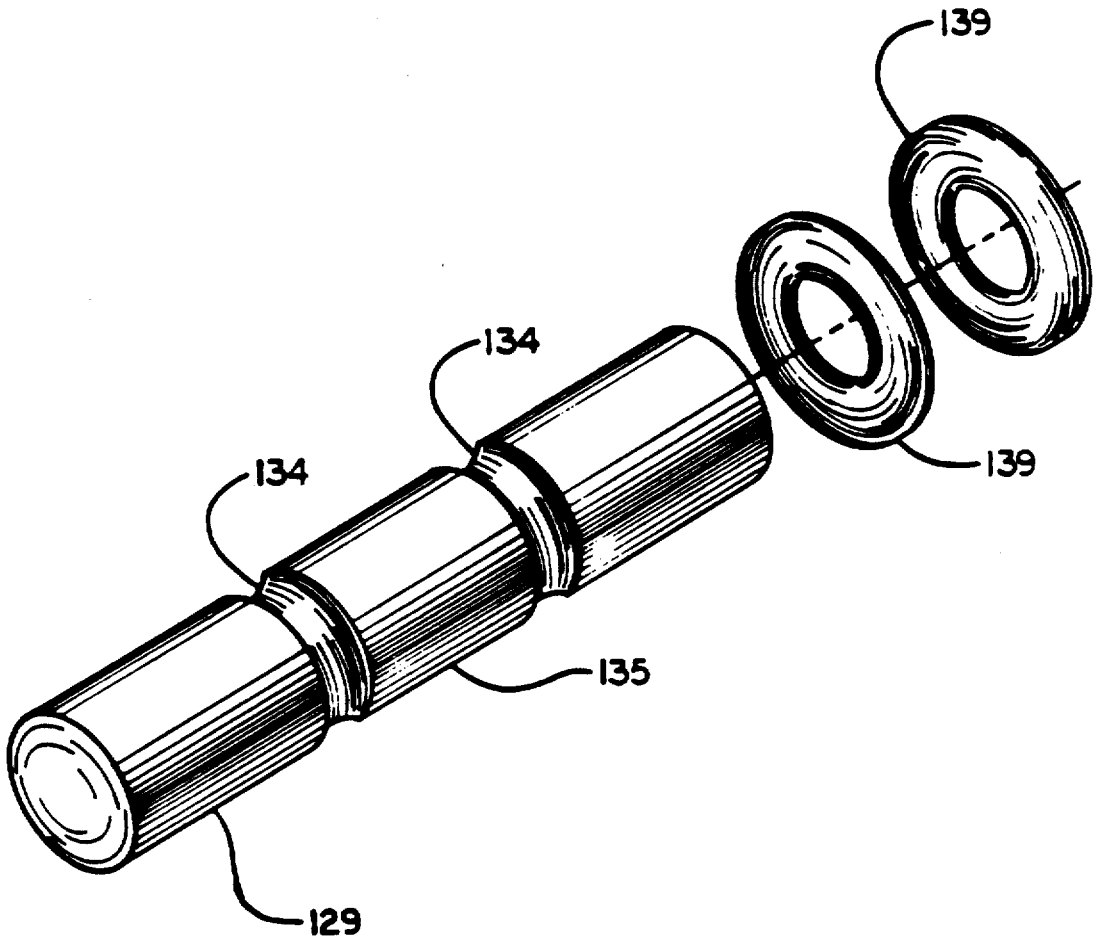
FIG. 19 shows exploded isometric view of multi-groove piston with "O" rings.
Figure 20:
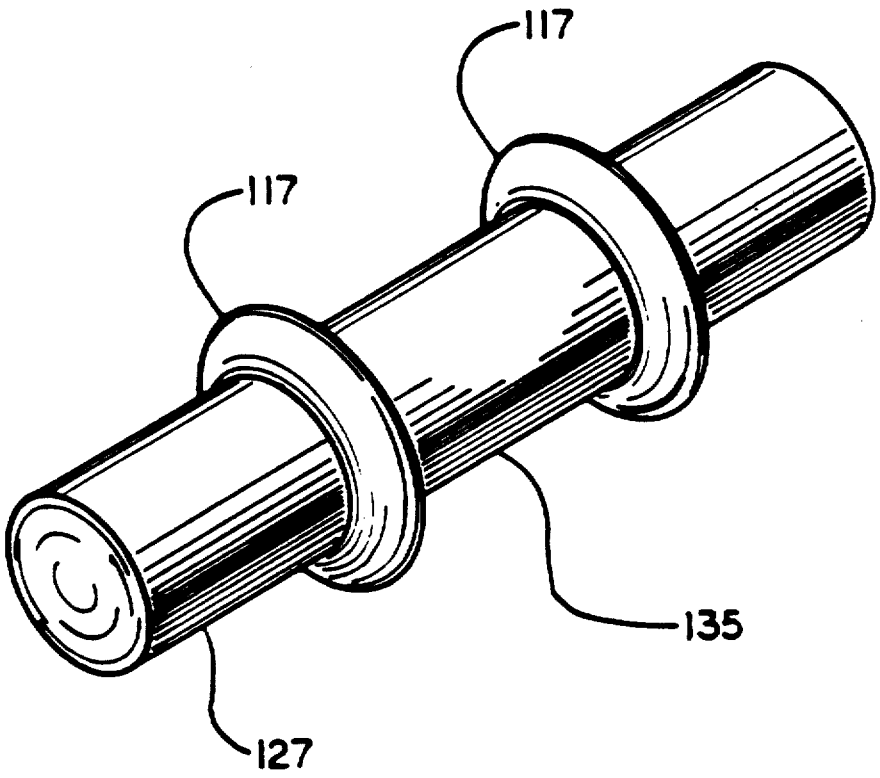
FIG. 20 shows isometric view of integrally formed rings piston.
Figure 21:
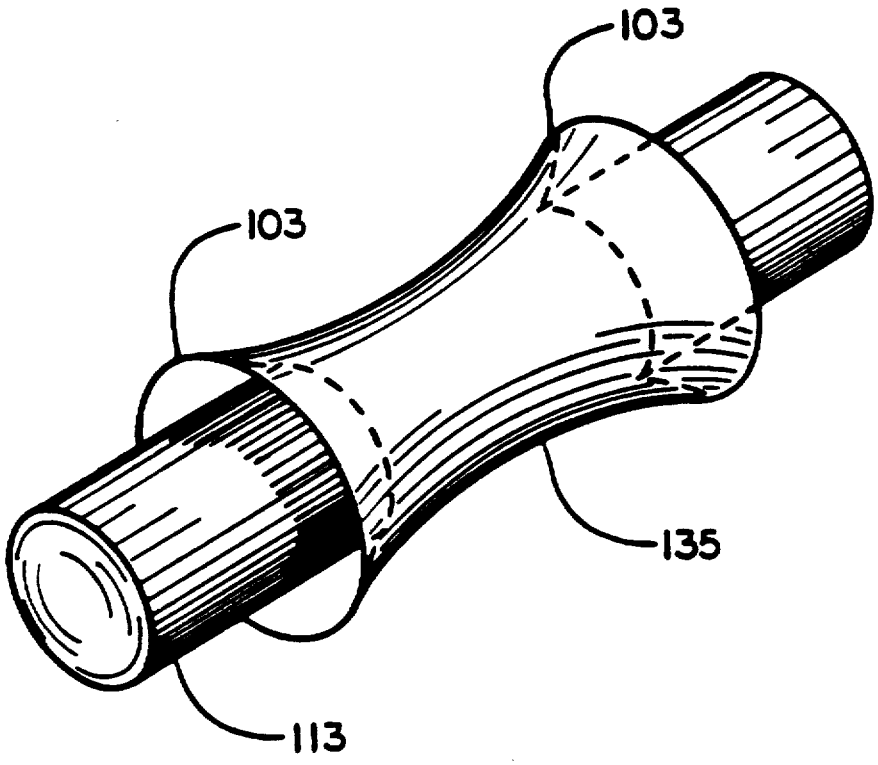
FIG. 21 shows isometric view of contoured integrally formed rings piston.

Alternative piston and ring configurations, as seen in FIGS. 19, 20 and 21, though somewhat different structurally, are provided that operate on the same general principles. Similar piston and ring parts of the alternative modes also define the circular channel 135. The multi-groove piston 129 with two "O" rings 139 (FIG. 19); the piston 127 with integrally formed rings 117 (FIG. 20): or the piston 127 with contoured integrally formed rings 103 (FIG. 21) may replace piston 131 with rings 133. These alternative modes all require lubrication with edible lubricating sealant 164, and function in substantially the same manner.

The integrally formed rings piston 127 is a convenient form of multi-groove piston 129 with "O" rings 139.

The contoured integrally formed rings piston 113 is a modification of piston 127, used in cases where it augments the hermetic sealing action of the lubricant 164.

When these alternative modes are employed, modification of the piston anchoring method is required. For example, the lubricated piston is held at the closed position and the plug 122 is chilled, freezing the lubricant 164 and anchoring the piston at the closed position. Alternative modes may be provided for anchoring the piston that are not dependent on this lubricant freezing effect. The device 106 is thereafter plugged, inserted, and sealed in the beverage can 100 as before. With the warm temperature of the beverage, the sealant 164 that surrounds the piston 131 melts, thereby allowing the air pressure in the chamber 136, to eject piston 131 to the fully retracted or open position. In this position, circular channel 135 adjoins outer orifice segment 125. Escaping refrigerant 114 gradually flows through inner segment 123, channel 135, and outer segment 125, which slightly pressurizes can be 100. This can pressure is transmitted via vent hold 118 . . . and so on as summarized above.

The rotatable rings 133 physical properties, with reference to those of an "O" ring 139, and methods of manufacture will be disclosed with greater particularity to FIGS. 10 through 18 and FIG. 22.

Figure 10:
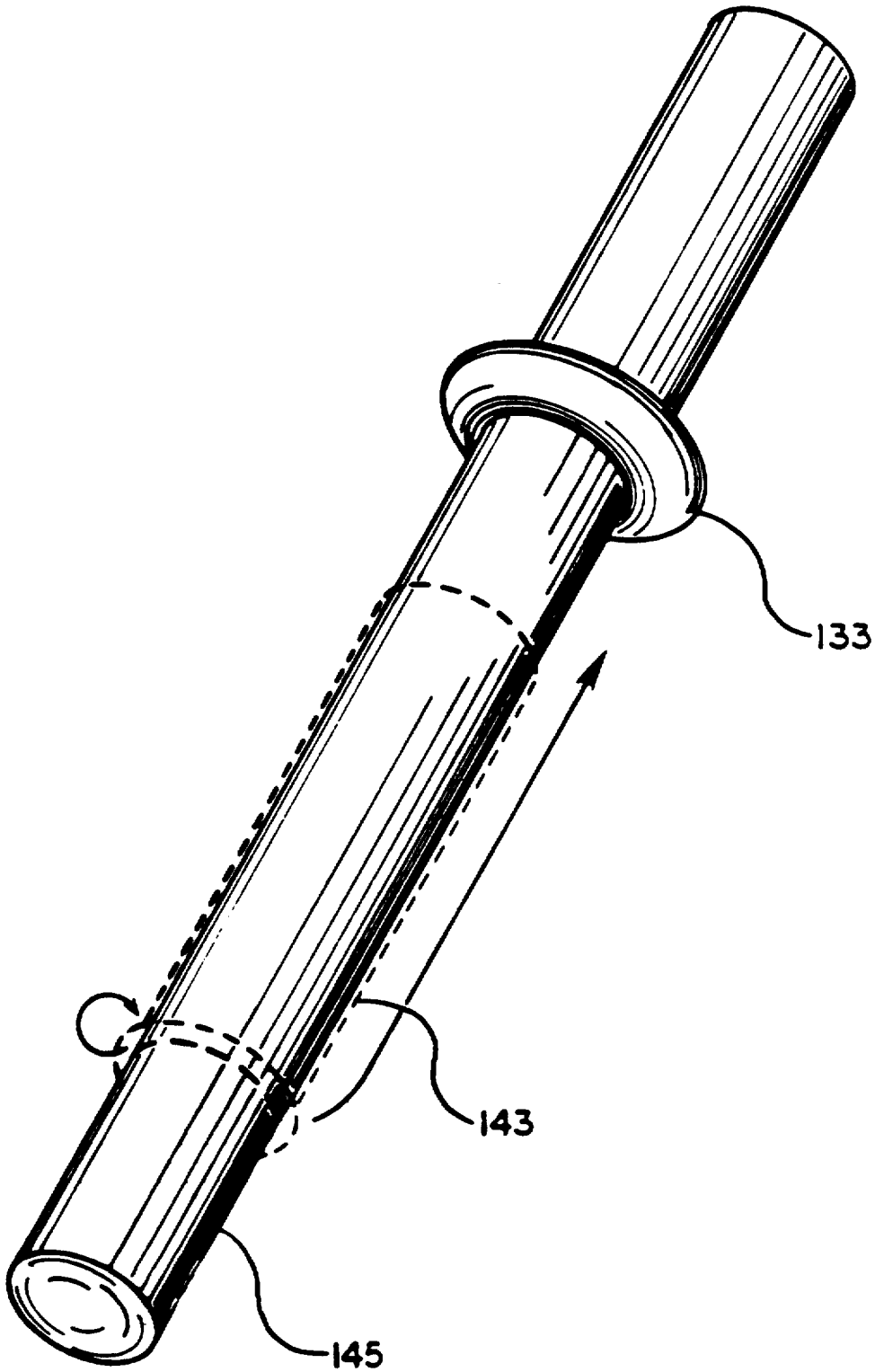
FIG. 10 shows isometric view, partially in phantom of method of forming axially rotatable rings.

A method of making rotatable rings 133 is illustrated in FIG. 10, where a heated tacky elastic tub 143 is "rolled" on a dowel 145 until it cools, thereby entering an altered molecular state wherein, when rotated to any degree, its inside diameter molecules are compressed, and its outside diameter molecules are stretched. It should be noted that the heated ring is moldable. Therefore, if it cools without being continually rotating, an ordinary "O" ring 139 will be produced.

Figure 22:
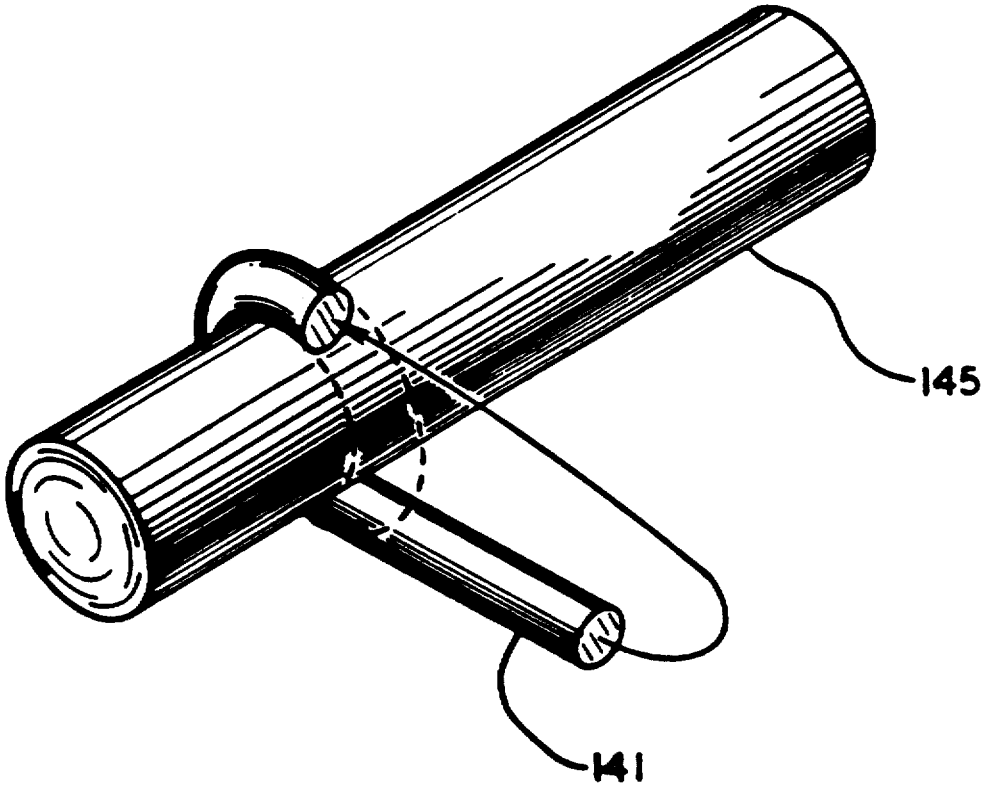
FIG. 22 shows isometric view, partially in phantom of alternative method of forming axially rotatable ring.

Alternative modes may be provided that are not dependent on this rotating until cool One such alternative is illustrated in FIG. 22. A length of elastic string 141 is wound around a dowel 145 into a circular shape, and its ends are then connected. In this process, the string 141 inner molecules are compressed, while its outer molecules are stretched, thereby entering the altered molecular state as above.

Figure 11:
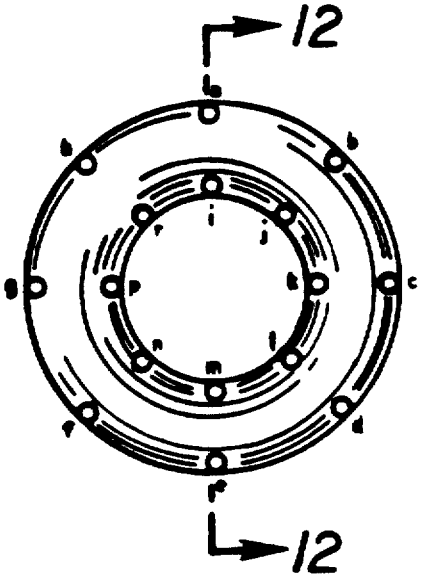
FIG. 11 shows random plan view of axially rotatable ring indicating compression of inner molecules and stretching of outer molecules.
Figure 12:
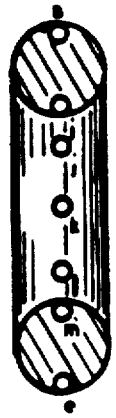
FIG. 12 shows sectional view of axially rotatable ring taken along line 12—12 of FIG. 11.
Figure 13:
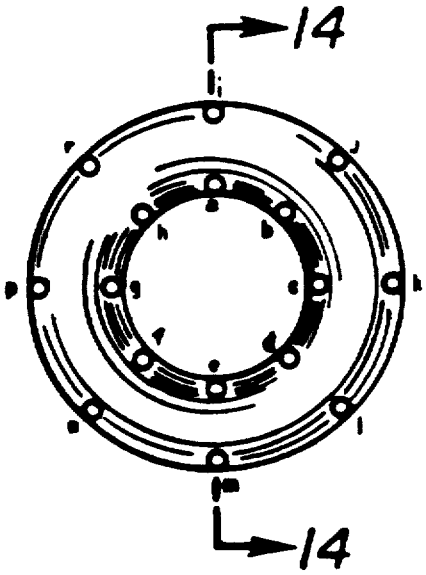
FIG. 13 shows plan view of axially rotatable ring of FIG. 11 axially rotated 180°.
Figure 14:
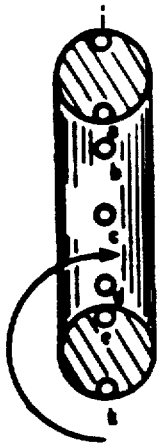
FIG. 14 shows sectional view of axially rotatable ring taken along line 14—14 of FIG. 13.
Figure 15:
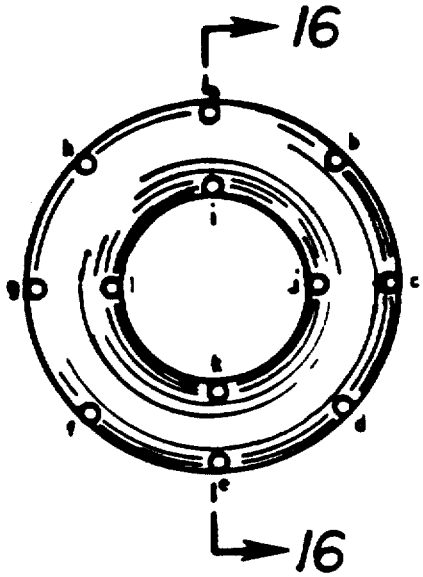
FIG. 15 shows plan view of "O" ring indicating neither compression of inner molecules nor stretching of outer molecules.
Figure 16:
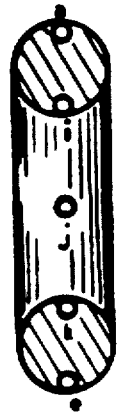
FIG. 16 shows sectional view of "O" ring taken along line 16—16 of FIG. 15.

Still another mode, not illustrated, is "rolling" an "O" ring 139 on a dowel 145 at a high rate of rotation so that heat is generated by repeatedly stretching and compressing its molecules. After heating the "O" ring 139 to a moldable temperature, the rate of rotation is reduced allowing the ring to cool, whereby it also enters the altered molecular state. So when a rotatable ring 133 is "rolled", the density of its outside diameter molecules and its inside diameter molecules is unaltered. A plan view, and a sectional view of ring 133 is seen in FIGS. 11 and 12, respectively. Its outside diameter molecules indicated by points a' through h' are stretched, while its inside diameter molecules indicated by points i' through r' are compressed. When "rolled" 180° as in FIGS. 13 and 14, or in fact to any degree, this density pattern is constant. This pattern contrasts with that of "O" ring 139 of FIGS. 15 through 18. In FIGS. 15 and 16, the outside diameter molecules represented by the points a through h, and inside diameter molecules represented by points i through l are neither stretched nor compressed.

Figure 17:
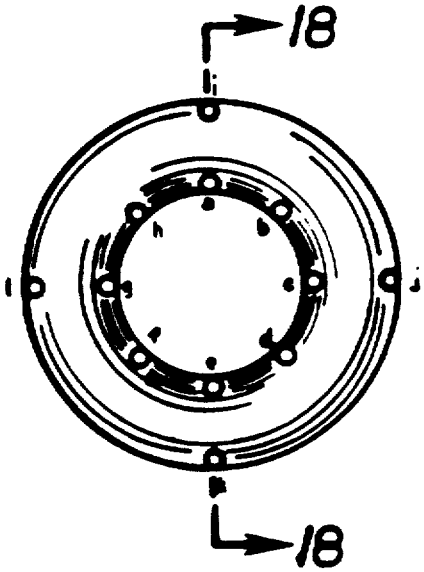
FIG. 17 shows plan view of "O" ring of FIG. 14 rotated 180° axially, indicating highly compressed inner molecules and highly stretched outer molecules.
Figure 18:
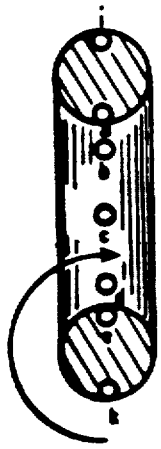
FIG. 18 shows sectional view of "O" ring taken along line 18—18 of FIG. 17.

And when the "O" ring 139 is rotated 180° or inverted, as in FIGS. 16 and 17, its density pattern is drastically altered. Its outside diameter molecules, indicated by points i through l are overly stretched, while its inside diameter molecules, indicated by points a through h, are over compressed. What all this means in terms of operations is that the "rollable" ring functions as a circular roller bearing for piston 131. This makes smooth, sensitive, piston action possible at lower pressure than alternative embodiments. And because ring 133 is compressible, it hermetically seals the piston and the cylinder without lubrication.

It will be appreciated by a person of skill in the art that the above embodiments may allow for variations in manufacturing, assembly, and design that come within the scope of the present invention. Further, two devices containing hypergolic gases could be employed in a self-heating embodiment of this invention. According to such an approach, these gases would be allowed to escape into a combustion chamber where they would mingle and spontaneously ignite. If the gases were oxygen and hydrogen, their exhaust fumes would be ordinary steam that could be allowed to vent into the beverage.

Other alternatives are available such that the scope of the invention is to be limited only by the following claims.

What is claimed is:

1. A self-cooling device for insertion in a beverage container or the like, comprising a refrigerant vessel means for holding a pressurized evaporative refrigerant comprising upright sidewalls terminating in upper and lower rims, a first plug hermetically sealing a lower end of said body, a second plug hermetically sealing upper end of said body, a vent hole being formed in said sidewall near said upper end adjacent to said upper plug, an off-set metering orifice comprising an inner segment and an outer segment for regulating the rate of escape of said refrigerant from said vessel formed axially in said upper plug, an automatic pressure actuated means for releasing said refrigerant comprising a plug cylinder formed radially at least partially through said second upper end plug and intersecting said inner and outer metering orifice segments, a pressure actuated piston positioned in and movable in said cylinder carrying two rings, a circular channel defined between said piston and said cylinder and between said rings whereby when said container is slightly pressurized, said pressure is transmitted to said piston via said vent hole, positioning said piston carrying said rings at a closed position in said cylinder where said channel is beyond said outer orifice segment, but when said container is depressurized upon opening, compressed air in said cylinder ejects said piston to an open position where said channel adjoins said outer orifice segment allowing said refrigerant to expand into said container and self-cool said device, and cooling said beverage.

2. A device as in claim 1 wherein said rings are axially rotatable.

3. A device as in claim 2 wherein said pressure actuated means includes in edible beverage-soluble adhesive holding said piston at said closed position.

4. A device as in claim 1 wherein said pressure actuated means includes a multi-groove piston carrying a plurality of said rings.

5. A device as in claim 1 wherein said pressure actuated means includes a piston carrying integrally formed rings.

6. A device as in claim 5 wherein said integrally formed rings are modified or contoured.

7. A device as in claims 4, or 5, or 6 wherein said pressure actuated means includes an edible lubricating sealant contained in said cylinder hermetically sealing said pistons and said cylinder.

8. A device as in claim 1 wherein said sealant is heat responsive whereby when heating said sealant, said piston is free to move in said cylinder to allow escape of said refrigerant.

9. A device as in claim 1 wherein said device comprises spacing means including at least one spacer attached to said vessel to provide a large area contacting said beverage but small areas contacting said vessel and said container.

10. A device in claim 9 wherein said spacing means comprise a pair of thermal transfer fin-spacers attached to said vessel so that they are held substantially parallel, and are of sufficient length to touch the inner surfaces of said container to hold said vessel upright in the middle of said container.

11. A device as in claim 1 wherein said refrigerant is a liquified atmospheric gas.

* * * * *